United States Patent [19]

Gillis

[11] 4,340,217

[45] Jul. 20, 1982

[54] MONKEY MAZE

[76] Inventor: Robert E. Gillis, P.O. Box 67, Aptos, Calif. 95003

[21] Appl. No.: 218,571

[22] Filed: Dec. 22, 1980

[51] Int. Cl.[3] ..... A63B 9/00

[52] U.S. Cl. ..... 272/113

[58] Field of Search ..... 272/61-64, 272/93, 109-113; 135/1 R, 1 C, 3 R, 3 B, 3 C; D21/245; 52/81, 633, 648, DIG. 10

[56] References Cited

U.S. PATENT DOCUMENTS

| | | | |
|---|---|---|---|
| 1,141,967 | 6/1915 | Lacoste | 52/648 X |
| 1,960,001 | 5/1934 | Davies | 135/1 R X |
| 2,704,667 | 3/1955 | Sanders | 272/113 |
| 2,956,806 | 10/1960 | Routson | 272/113 |
| 3,120,955 | 2/1964 | Carlin | 272/113 |
| 3,705,473 | 12/1972 | Yeffal-Rueda | 52/648 X |
| 3,722,153 | 3/1973 | Baer | 52/648 X |
| 3,866,366 | 2/1975 | Fuller | 52/648 X |
| 3,970,301 | 7/1976 | Lehmann | 272/113 |
| 4,097,043 | 6/1978 | Rudy | 272/113 |
| 4,259,821 | 4/1981 | Bush | 52/648 X |

FOREIGN PATENT DOCUMENTS

| | | | |
|---|---|---|---|
| 210209 | 9/1957 | Australia | 272/112 |
| 1080671 | 6/1954 | France | 272/113 |
| 626476 | 7/1949 | United Kingdom | 272/113 |

*Primary Examiner*—Richard J. Apley
*Attorney, Agent, or Firm*—Robert G. Slick

[57] ABSTRACT

A climbing maze for children is provided by fastening together a plurality of rods. The maze includes three triangular members which are arranged with their apices resting on the ground and having the tops of the triangles intermeshed with each other and having a fourth triangular member arranged in a horizontal plane below the tops of the first three triangular members. The maze also includes three straight members resting on the ground and engaging the apices of the fourth triangular member and being lashed to the other triangular members where they cross. Preferably the rods are of ordinary plastic plumbing pipe.

4 Claims, 5 Drawing Figures

MONKEY MAZE

SUMMARY OF THE INVENTION

This invention relates to a climbing maze for children. The maze is preferably constructed of rods which can be ordinary plastic plumbing pipes. These pipes are somewhat flexible, strong, non-corrosive and inexpensive.

The plastic plumbing pipes preferably used in the construction are relatively soft so that a child is less likely to get injured in falling against one. Further, the plastic does not rust or corrode as metal might do. However, metal, wood or other types of pipes would work and could be used instead of plastic pipe.

The maze of the present invention is very simple to construct since it may be made merely be lashing the parts together. Although at first glance the structure looks very flimsy it is surprisingly strong and almost indestructable.

One feature of the present invention is the parts can be easily assembled or disassembled so the maze occupys very little space when not in use.

After the maze is assembled, all pole segments between connections are of equal length, have support at their ends and form a leg of a triangle. This makes for maximum strength and stability with minimum weight, connecting and material cost.

Other features and advantages of the invention will be brought out in the balance of the specification.

DESCRIPTION OF THE PREFERRED EMBODIMENTS

Figure 1:
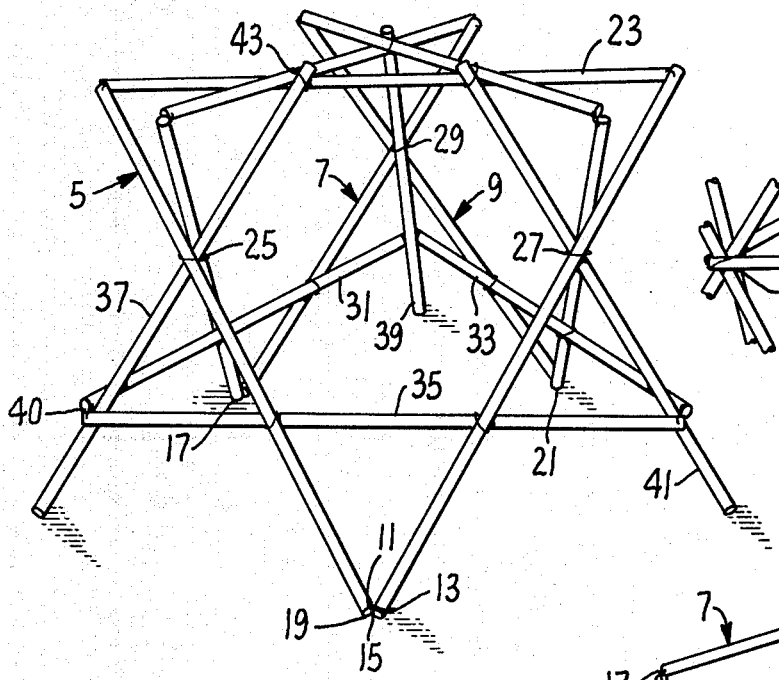
FIG. 1 is a perspective view of a maze embodying the present invention.

In accordance with the present invention the maze includes three triangular members designated 5, 7 and 9. These triangular members are identical and preferably each is an equilateral triangle although some departure can be made from this requirement. At each apex of the triangular members holes are bored in mating pieces as at 11 and 13 and the two ends are preferably joined with a flexible cord 15. The three triangular members are spaced apart an equal distance and each arranged with an apex down so that each triangle has one apex, as shown at 17, 19 and 21, resting on the ground while the three sides opposite these angles substantially define an imaginary plane parallel to the ground as at 23. Further, each adjacent pair of apices intermesh with its neighbors forming first series of crossings of the sides of the triangle which are designated 25, 27 and 29. A fourth equilateral triangle defined by the sides 31, 33 and 35 is interleaved with the downwardly extending portions of triangles 5, 7 and 9. This forms a second series of crossings.

To complete the structure three straight members 37, 39 and 41 are employed and these are located at each apex of the fourth triangle so the member 37 extends through the apex 40 up to the first crossing 25 and then terminates at the plane of the top members to form a third series of crossings as at 43. Now all of the crossings are lashed together using a flexible cord so that the member 37 is lashed to the apex 39, the three members crossing at 25 are lashed together and the three members crossing at 43 are lashed together, utilizing a flexible cord. Of course, the other three corners are treated in the same manner.

Figure 4:
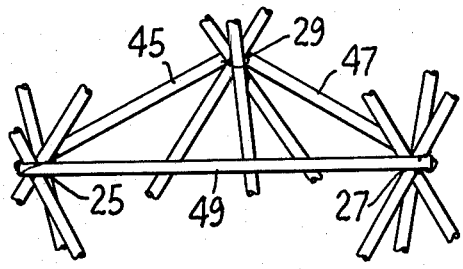
FIG. 4 illustrates a modification suitable for beginners or small children.

For beginners or very young children, the modification of FIG. 4 may be used. Three short elements 45, 47 and 49 are fastened to the points 25, 27 and 29. This makes the device easier and safer to climb and play on. As more skill is acquired, these pieces may be moved to make the device more challenging.

Figure 5:
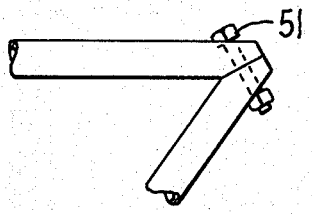
FIG. 5 illustrates an alternate corner structure.
Figure 2:
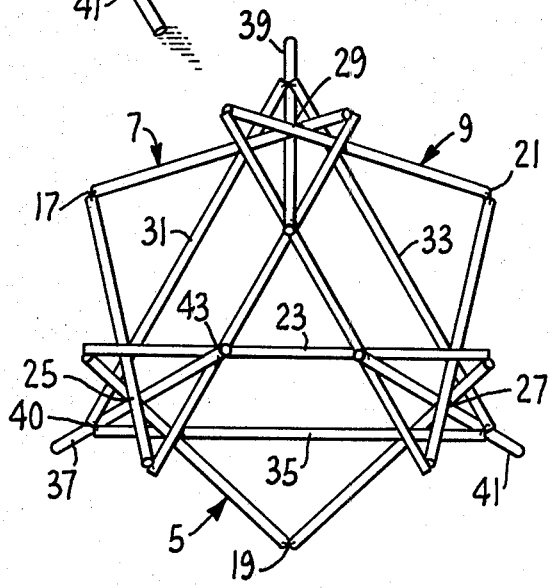
FIG. 2 is a top view of the maze.

It has previously been mentioned that the poles were lashed together. Although this is preferred, the poles may be fastened together in a more rigid fashion such as bolts, "U" bolts or a molded binding fixture. Even with rigid fastenings, the poles can still flex. FIG. 5 illustrates such an alternate fastening means wherein a bolt 51 passes through holes in adjacent poles.

Figure 3:
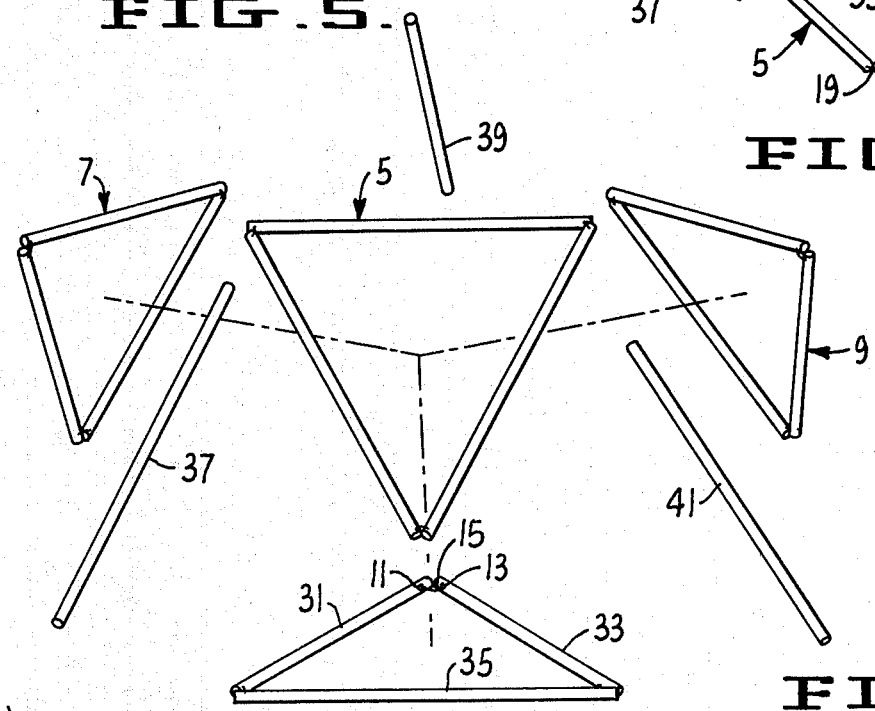
FIG. 3 is an exploded view of the parts forming the maze.

Thus, there is formed a very strong, light semi-flexible structure which is safe for children to climb upon. The structure can be easily taken down and stored flat by disconnecting the crossing members, but leaving the triangular members intact as is shown in FIG. 3. For even more compact storage each of the triangular members can be further reduced in size merely by disconnecting the connectors at one of the apices. This allows the structure to be placed in a box having a small cross section for storage or sale.

I claim:

1. A climbing maze for children normally resting on a plane surface such as the ground comprising in combination:

a. three triangular members of substantially equilateral configuration formed of poles joined at the apices, b. each of said triangular members being arranged with one of the apices down, resting on the ground and equally spaced from each other, with the opposite sides to said apices substantially forming an imaginary horizontal plane parallel to the ground, c. each of said triangular members having its top apices intermeshed with those of a neighbor, forming a plurality of first crossings, d. a fourth triangular member extending in a horizontal plane around said three triangles, forming a second series of crossings therewith, e. three straight members, each lying inside and engaging one of the apices of said fourth triangle and extending upward onto the plane formed by the bases of said three triangles and down to the ground to form a third series of crossings and f. binding means binding the members together at each of said crossings.

2. The structure of claim 1 wherein each member is formed of plastic pipe.

3. The structure of claim 1 wherein the binding means of paragraph f is a flexible binding means.

4. The structure of claim 1 having the following additional members:

a. three short poles connecting said first series of crossings, and b. said 3 short poles being removable without disturbing the balance of the maze.

* * * * *